US012195830B2

(12) United States Patent
Yang et al.

(10) Patent No.: US 12,195,830 B2
(45) Date of Patent: Jan. 14, 2025

(54) ALUMINUM ALLOY, PREPARATION METHOD, AND ALUMINUM ALLOY STRUCTURAL MEMBER

(71) Applicant: BYD COMPANY LIMITED, Shenzhen (CN)

(72) Inventors: Yang Yang, Shenzhen (CN); Qiang Guo, Shenzhen (CN); Xiaodong Wang, Shenzhen (CN); Mengjue Liao, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 458 days.

(21) Appl. No.: 17/621,500

(22) PCT Filed: Nov. 14, 2019

(86) PCT No.: PCT/CN2019/118477
§ 371 (c)(1),
(2) Date: Dec. 21, 2021

(87) PCT Pub. No.: WO2021/003939
PCT Pub. Date: Jan. 14, 2021

(65) Prior Publication Data

US 2022/0349033 A1 Nov. 3, 2022

(30) Foreign Application Priority Data

Jul. 5, 2019 (CN) ..... 201910602893.X

(51) Int. Cl.
*C22C 21/02* (2006.01)
*B22D 21/04* (2006.01)
*C22C 1/02* (2006.01)

(52) U.S. Cl.
CPC ..... *C22C 21/02* (2013.01); *B22D 21/04* (2013.01); *C22C 1/026* (2013.01)

(58) Field of Classification Search
CPC ..... C22C 21/02; C22C 21/10; C22C 1/026; C22F 1/043; C22F 1/053; B22D 21/04
See application file for complete search history.

(56) References Cited

U.S. PATENT DOCUMENTS

| | | | |
|---|---|---|---|
| 2001/0028861 | A1 | 10/2001 | Que-Tsang et al. |
| 2012/0000578 | A1 | 1/2012 | Wang et al. |
| 2018/0043476 | A1 | 2/2018 | Ishigami et al. |

FOREIGN PATENT DOCUMENTS

| | | | |
|---|---|---|---|
| CN | 101311283 | A | 11/2008 |
| CN | 102312135 | A | 1/2012 |
| CN | 104745897 | A | 7/2015 |
| CN | 105088033 | A | 11/2015 |
| CN | 105296818 | A | 2/2016 |
| CN | 105603269 | A | 5/2016 |
| CN | 106148771 | A | 11/2016 |
| CN | 106167868 | A | 11/2016 |
| CN | 106811630 | A | 6/2017 |
| CN | 107365926 | A | 11/2017 |
| CN | 108034869 | A | 5/2018 |
| CN | 108103330 | A | 6/2018 |
| CN | 108251715 | A | 7/2018 |
| CN | 108277397 | A | 7/2018 |
| EP | 0725153 | A1 | 8/1996 |
| WO | 2016015488 | A1 | 2/2016 |

OTHER PUBLICATIONS

English Abstract and English Machine Translation of Zhang et al. (WO 2016015488). (Feb. 4, 2016).*
The World Intellectual Property Organization (WIPO) International Search Report for PCT/CN2019/118477 Apr. 15, 2020 6 pages (with translation).

* cited by examiner

*Primary Examiner* — Jessee R Roe
(74) *Attorney, Agent, or Firm* — Wenye Tan

(57) ABSTRACT

An aluminum alloy based on a total weight of the aluminum alloy, in percentages by weight, includes 9.12% of Si, 8-11% of Zn, 0.5-1.5% of Mg, 0.2-0.8% of Cu, 0-0.6% of Fe, 0.08-0.25% of Mn, 0-0.10% of Sr, 0-0.05% of Sc, 0-0.5% of Er, and 73.2-82.22% of Al.

20 Claims, No Drawings

ALUMINUM ALLOY, PREPARATION METHOD, AND ALUMINUM ALLOY STRUCTURAL MEMBER

This application is a national phase entry under 35 U.S.C. § 371 of International Application No. PCT/CN2019/118477, filed on Nov. 14, 2019, which claims priority to Chinese Patent Application No. 201910602893.X, filed by the BYD Co., Ltd. on Jul. 5, 2019, and entitled ALUMINUM ALLOY, PREPARATION METHOD THEREFOR AND ALUMINUM ALLOY STRUCTURAL MEMBER, the entire content of all of which is incorporated herein by reference.

FIELD

The present disclosure relates to the field of material technology, and particularly to an aluminum alloy, a preparation method, and an aluminum alloy structural member.

BACKGROUND

Die casting is one of the basic forming methods of aluminum alloys and can be used for designing complex structural member products. The most commonly used die-casting aluminum alloy is the Ai-Si—Cu die-casting alloy ADC12 specified by the Japanese Industrial Standard JISH5302, which has been widely used in die-casting aluminum alloy products for its good fluidity and formability, large forming process window, and high cost performance. The ADC12 has the advantage of low density and can be used for die-casting housings, small thin products brackets, etc. However, the strength and thermal conductivity of products die-casted from ADC12 are general, with the tensile strength being 230-250 MPa, the yield strength being 160-190 MPa, the elongation rate being less than 3%, and the thermal conductivity (i.e., thermal conductivity coefficient) being 96 W/m·K, which can easily lead to problems such as product deformation and poor heat transfer and hence cannot meet the strength and heat dissipation requirements of existing mobile phones, notebook computers and other products.

Therefore, the current technologies related to aluminum alloys still need to be improved.

SUMMARY

The present disclosure aims to solve, at least to some extent, one of the technical problems in the related art. In view of this, an objective of the present disclosure is to provide an aluminum alloy having good mechanical properties, thermal conductivity and die-casting performance.

According to one aspect of the present disclosure, an aluminum alloy is provided. According to an embodiment of the present disclosure, based on the total weight of the aluminum alloy, the aluminum alloy includes, in percentages by weight: 9-12% of Si; 8-11% of Zn; 0.5-1.5% of Mg; 0.2-0.8% of Cu; 0-0.6% of Fe; 0.08-0.25% of Mn; 0-0.10% of Sr; 0-0.05% of Sc; 0-0.5% of Er; and 73.2-82.22% of Al. The aluminum alloy has good strength, thermal conductivity and die-casting performance at the same time, can meet the requirements for the use of structural members with high thermal conductivity and strength requirements, and is suitable for the manufacture of structural members of 3C (computer, communication and consumer electronics) products, automobile radiators, turbine discs, lighting device, etc.

According to another aspect of the present disclosure, the present disclosure provides a method for preparing the aluminum alloy described above. According to an embodiment of the present disclosure, the method includes: heating to melt aluminum, a silicon-containing raw material, a copper-containing raw material, an iron-containing raw material, a manganese-containing raw material, a strontium-containing raw material, a scandium-containing raw material, an erbium-containing raw material, a zinc-containing raw material, and a magnesium-containing raw material to obtain a molten aluminum alloy; and sequentially stirring, refining and casting the molten aluminum alloy to obtain the aluminum alloy. This method is simple and convenient to operate and suitable for industrial production. The obtained aluminum alloy not only has high thermal conductivity, but also has good mechanical properties and die-casting performance.

According to another aspect of the present disclosure, the present disclosure provides an aluminum alloy structural member. According to an embodiment of the present disclosure, at least a part of the aluminum alloy structural member is made of the aluminum alloy described above. The aluminum alloy structural member has all the features and advantages of the aluminum alloy described above, so the details will not be repeated here.

DETAILED DESCRIPTION

Embodiments of the present disclosure will be described in detail below. The embodiments described below are exemplary, and are merely used for explaining the present disclosure, rather than limiting the disclosure. The embodiments in which specific technologies or conditions are not indicated shall be implemented according to the technologies or conditions described in the literatures in the art or the instructions for the product. The reagents or instruments for which no manufacturers are noted are all common products commercially available from the market.

According to one aspect of the present disclosure, the present disclosure provides an aluminum alloy. According to an embodiment of the present disclosure, based on the total weight of the aluminum alloy, the aluminum alloy includes, in percentages by weight: 9-12% of Si; 8-11% of Zn; 0.5-1.5% of Mg; 0.2-0.8% of Cu; 0-0.6% of Fe; 0.08-0.25% of Mn; 0-0.10% of Sr; 0-0.05% of Sc; 0-0.5% of Er; and 73.2-82.22% of Al.

Specifically, the specific content of Si element in the aluminum alloy may be 9%, 10.5%, 11.5%, 12%, etc. As the main mechanical strengthening element, Si element can be dissolved in Al to form an α-Al solid solution and a eutectic or sub-eutectic Al—Si phase, which improves the mechanical properties of the aluminum alloy while ensuring the fluidity during die-casting and taking into account the yield of mass production. However, because the addition of Si causes the thermal conductivity of aluminum alloy to decrease, its content needs to be controlled. The addition of Si within the above content range can make the aluminum alloy have good mechanical properties, thermal conductivity and die-casting performance at the same time. If the Si content is too low, the mechanical properties and die-casting performance of the aluminum alloy are poor. If the Si content is too high, the thermal conductivity of the aluminum alloy is low.

Specifically, the specific content of Zn in the aluminum alloy may be 8%, 9.5%, 10.5%, 11%, etc. Zn in the solid solution state can slowly precipitate to form the strengthening phase by natural aging. Moreover, Zn in the solid solution state has little impact on the thermal conductivity of Al, and the addition of Zn within the above content range can achieve a strengthening effect while ensuring a good thermal conductivity. If the Zn content is too low, the mechanical properties of the aluminum alloy are poor. If the Zn content is too high, the thermal conductivity of the aluminum alloy is affected, and the thermal conductivity of the aluminum alloy is low.

Specifically, the specific content of Mg in the aluminum alloy may be 0.05%, 0.08%, 0.12%, 0.15%, etc. Mg can form a strengthening phase $Mg_2Si$ with Si, and can form strengthening phases such as $MgZn_2$ and $AlMg_3Zn_2$ with Zn and Al, which have a significant strengthening effect. The addition of a small amount of Mg can significantly increase the strength of the aluminum alloy. However, if the Mg content is too high, the toughness and plasticity of the aluminum alloy decrease, and the thermal conductivity of the aluminum alloy is greatly reduced. It is found by the inventors through experimental verification that the addition of Mg within the above content range can make the aluminum alloy have excellent mechanical properties without adversely affecting the thermal conductivity, and can still maintain a good thermal conductivity.

Specifically, the specific content of Cu in the aluminum alloy may be 0.2%, 0.5%, 0.7%, 0.8%, etc. Cu atoms can be dissolved into the Al—Zn—Mg phase and the aluminum matrix to form a super hard phase. However, an excessive amount of the Al—Zn—Mg—Cu phase will cause the fracture toughness and the elongation rate of aluminum alloy to decrease. The addition of Cu within the above content range can effectively strengthen the aluminum alloy without excessively affecting the fracture toughness and the elongation rate of the aluminum alloy, so that the aluminum alloy has good strength, fracture toughness and elongation rate.

Specifically, the aluminum alloy may or may not contain Fe, and the specific content of Fe in the aluminum alloy may be 0%, 0.2%, 0.4%, 0.6%, etc. Fe element can prevent mold sticking during die casting of aluminum alloy, but excess Fe will lead to the formation of acicular or flake-like Al—Si—Fe phases in the aluminum alloy, which splits the grains, reduces the toughness of the aluminum alloy, and easily causes the product to fracture. The addition of Fe within the above content range can ensure the aluminum alloy has good performance against mold sticking without affecting the mechanical properties of the aluminum alloy.

Specifically, the specific content of Mn in the aluminum alloy may be 0.08%, 0.15%, 0.25%, etc. Mn provides a supplementary strengthening effect, which is better than that achieved by the same amount of Mg. In addition, Mn can form the $(Fe,Mn)Al_6$ phase with Al and Fe, making the alloy have a better plasticity. However, because Mn significantly reduces the thermal conductivity of the aluminum alloy, the amount of Mg added needs to be limited. It has been verified by experiments that the addition of Mn within the above content range can provide a good supplementary strengthening effect to make the aluminum alloy have ideal mechanical properties without affecting the thermal conductivity of the aluminum alloy, so that the aluminum alloy has ideal mechanical properties and thermal conductivity at the same time.

Further, the ratio of Fe to Mn can be (2.5-3.5):1 (for example, 2.5:1, 3.0:1, 3.5:1, etc.). In this way, Mn can better transform the acicular iron phase into the skeleton to eliminate the splitting effect on the aluminum alloy, so as to achieve a better coordination and synergy between the elements, thereby further improving the performance of the aluminum alloy during use.

Specifically, the aluminum alloy of the present disclosure may or may not contain Sr. The specific content of Sr in the aluminum alloy may be 0%, 0.01%, 0.05%, 0.1%, etc. Sr can be added to the aluminum alloy as a modifier to refine the α-Al solid solution and the acicular Si phase, to improve the structure of the aluminum alloy, purify the grain boundary, and reduce the resistance to electron movement in the alloy, thereby further improving the thermal conductivity and mechanical properties of the aluminum alloy. However, excess Sr will lead to the formation of a brittle phase, which reduce the mechanical properties of the aluminum alloy. The addition of Sr within the above content range can better improve the thermal conductivity and mechanical properties of the aluminum alloy.

Specifically, the aluminum alloy of the present disclosure may or may not contain Sc or/and Er, i.e., the aluminum alloy may contain neither Sc nor Er, contain only Sc but not Er, contain only Er but not Sc, or contain both Sc and Er. It is found by the inventors of the present disclosure that the addition of rare earth elements such as Sc and Er can effectively improve the mechanical properties of the aluminum alloy of the present disclosure. The addition of rare earth elements is conducive to purifying the molten aluminum alloy, refining the grains, and improving the structure, thereby improving the comprehensive performance of the aluminum alloy. Taking into account the cost of the aluminum alloy, the content in percentage by weight of rare earth element Sc in the aluminum alloy is 0.05% or less (e.g., 0%, 0.03%, 0.05%, etc.), and may specifically be 0.015-0.025% based on the total weight of the aluminum alloy. Further, because the price of Er is about 1/(20-25) of Sc, Er can be added in large quantities in place of Sc to greatly reduce the cost of the aluminum alloy. Specifically, the content in percentage by weight of rare earth element Er in the aluminum alloy is 0.5% or less (e.g., 0%, 0.2%, 0.5%, etc.), and may specifically be 0.15-0.35% based on the total weight of the aluminum alloy.

Specifically, the specific content of aluminum in the aluminum alloy of the present disclosure may be 73.2%, 76%, 79%, 82%, 82.22%, etc.

It is to be appreciated by those skilled in the art that in the related art, for aluminum alloys, there is a negative correlation between strength and thermal conductivity, and a higher strength of the aluminum alloy often indicates a lower thermal conductivity. The die-casting aluminum alloy provided by the present disclosure not only has improved strength, but also has a higher thermal conductivity and die-casting performance, can meet the requirements for the use of structural members with high thermal conductivity and strength requirements, and is suitable for the manufacture of structural members of 3C products, automobile radiators, turbine discs, lighting device, etc.

According to an embodiment of the present disclosure, based on the total weight of the aluminum alloy, the aluminum alloy includes, in percentages by weight: 10-11% of Si; 9.5-10.5% of Zn; 0.7-1% of Mg; 0.35-0.65% of Cu; 0.35-0.5% of Fe; 0.12-0.18% of Mn; 0.02-0.05% of Sr; 0.015-0.025% of Sc; 0.15-0.35% of Er; and 75.745-78.795% of Al. When the contents of the elements fall within the above ranges, the thermal conductivity, mechanical properties, and die-casting performance of the aluminum alloy are further improved.

According to an embodiment of the present disclosure, based on the total weight of the aluminum alloy, the aluminum alloy satisfies at least one of the following conditions, in percentages by weight: the content of each impurity element is less than 0.01%; and the total content of the impurity elements is less than 0.1%. Specifically, Because the purity of raw materials is difficult to reach 100%, and impurities are likely to be introduced during the preparation process, aluminum alloys usually contain inevitable impurities (such as Ca, P, Zr, Cr, Pb, Be, Ti, Ni, etc.) In the present disclosure, the content of each impurity element in the aluminum alloy may specifically be 0.01%, 0.009%, 0.008%, 0.007%, 0.006%, 0.005%, 0.004%, 0.003%, 0.002%, 0.001%, etc., and the total content of the impurity elements may specifically be 0.1%, 0.09%, 0.08%, 0.07%, 0.06%, 0.05%, 0.04%, 0.03%, 0.02%, 0.01%, etc. Specifically, in an example where the aluminum alloy contains three impurity elements, i.e., Ti, Zr and Ni, the content of each of Ti, Zr and Ni is less than 0.01%, and the sum of the contents of Ti, Zr and Ni is less than 0.1%. In this way, the various properties of the aluminum alloy can be well ensured to meet the requirements, without adversely affecting the aluminum alloy.

According to an embodiment of the present disclosure, based on the total weight of the aluminum alloy, the aluminum alloy includes the following components in percentages by weight: 9-12% of Si; 8-11% of Zn; 0.5-1.5% of Mg; 0.2-0.8% of Cu; 0-0.6% of Fe; 0.08-0.25% of Mn; 0-0.10% of Sr; 0-0.05% of Sc; 0-0.5% of Er; and the balance of Al. The aluminum alloy with the above-mentioned components at the above ratio has thermal conductivity, mechanical properties and die-casting performance at the same time, can meet the requirements for high strength and thermal conductivity, and is suitable for the manufacture of structural members of 3C products, automobile radiators, turbine discs, lighting device, etc.

According to an embodiment of the present disclosure, based on the total weight of the aluminum alloy, the aluminum alloy includes the following components in percentages by weight: 10-11% of Si; 9.5-10.5% of Zn; 0.7-1% of Mg; 0.35-0.65% of Cu; 0.35-0.5% of Fe; 0.12-0.18% of Mn; 0.02-0.05% of Sr; 0.015-0.025% of Sc; 0.15-0.35% of Er; and the balance of Al. The aluminum alloy with the above-mentioned components at the above ratio has further improved thermal conductivity, mechanical properties and die-casting performance, and is more suitable for the manufacture of structural members of 3C products, automobile radiators, turbine discs, lighting device, etc.

According to an embodiment of the present disclosure, the aluminum alloy satisfies at least one of the following conditions: the yield strength is greater than or equal to 245 MPa and may specifically be 245-270 MPa (e.g., 250 MPa, 260 MPa, 270 MPa, etc.), the tensile strength is greater than or equal to 390 MPa and may specifically be 390-420 MPa (e.g., 390 MPa, 400 MPa, 410 MPa, 420 MPa, etc.), the elongation rate is greater than or equal to 3% and may specifically be 3-4% (e.g., 3%, 3.1%, 3.2%, 3.3%, 3.4%, 3.5%, 3.8%, 4.0%, etc.), and the thermal conductivity is greater than or equal to 125 W/m·K and may specifically be 125-140 W/m·K (e.g., 125 W/m·K, 130 W/m·K, 140 W/m·K, etc.). Specifically, the aluminum alloy satisfies any one of the above conditions, any two of the above conditions, any three of the above conditions, or all the four conditions. In some specific embodiments, the aluminum alloy may satisfy all the four conditions. In this way, the aluminum alloy has good strength, thermal conductivity and die-casting performance at the same time, can meet the requirements for high strength and thermal conductivity, and is suitable for the manufacture of structural members of 3C products, automobile radiators, turbine discs, lighting device, etc.

According to another aspect of the present disclosure, the present disclosure provides a method for preparing the aluminum alloy described above. According to an embodiment of the present disclosure, the method includes: heating to melt aluminum, a silicon-containing raw material, a copper-containing raw material, an iron-containing raw material, a manganese-containing raw material, a strontium-containing raw material, a scandium-containing raw material, an erbium-containing raw material, a zinc-containing raw material, and a magnesium-containing raw material to obtain a molten aluminum alloy; and sequentially stirring, refining and casting the molten aluminum alloy to obtain the aluminum alloy. This method is simple and convenient to operate and suitable for industrial production. The obtained aluminum alloy not only has high thermal conductivity, but also has good mechanical properties and die-casting performance.

According to an embodiment of the present disclosure, the method may specifically include: heating to melt aluminum and the silicon-containing raw material, heating to melt after adding the copper-containing raw material, the iron-containing raw material, the manganese-containing raw material, the strontium-containing raw material, the scandium-containing raw material, and the erbium-containing raw material to obtain a first molten aluminum alloy; adding the zinc-containing raw material to the first molten aluminum alloy, and heating to melt, followed by scum removal treatment to obtain a second molten aluminum alloy; adding the magnesium-containing raw material to the second molten aluminum alloy under a protective atmosphere, and heating to melt to obtain a third molten aluminum alloy; and sequentially stirring, refining and casting the third molten aluminum alloy to obtain the aluminum alloy.

According to the embodiments of the present disclosure, the forms of the above-mentioned raw materials are not particularly limited, and may be flexibly selected according to actual needs. For example, aluminum may be provided in the form of an aluminum ingot, and the silicon-containing raw material, the copper-containing raw material, the iron-containing raw material, the manganese-containing raw material, the strontium-containing raw material, the scandium-containing raw material, the erbium-containing raw material, the zinc-containing raw material, and the magnesium-containing raw material may be provided in the form of elemental metals or intermediate alloys. In some specific embodiments of the present disclosure, the method may include: heating to melt an aluminum ingot and an aluminum-silicon intermediate alloy, heating to melt after adding aluminum-copper, aluminum-iron, aluminum-manganese, aluminum-strontium, aluminum-scandium and aluminum-erbium intermediate alloys to obtain the first molten aluminum alloy; adding a zinc ingot to the first molten aluminum alloy, and heating to melt, followed by scum removal treatment to obtain the second molten aluminum alloy; adding a magnesium ingot to the second molten aluminum alloy under a protective atmosphere, and heating to melt to obtain the third molten aluminum alloy; and sequentially stirring, refining and casting the third molten aluminum alloy to obtain the aluminum alloy. This method is simple and convenient to operate and suitable for industrial production. The obtained aluminum alloy not only has high thermal conductivity, but also has good mechanical properties and die-casting performance.

Specifically, the method may include the following steps: weighing a pure aluminum ingot, an Al—Si intermediate alloy, a pure Zn ingot, a pure Mg ingot, an Al—Cu intermediate alloy, an Al—Fe intermediate alloy, an Al—Mn intermediate alloy, an Al—Sr intermediate alloy, an Al—Sc intermediate alloy, and an Al—Er intermediate alloy as raw materials according to a ratio; then smelting the pure aluminum ingot and the Al—Si intermediate alloy in a crucible until the mixture is completely melted; adding the Al—Cu intermediate alloy, the Al—Fe intermediate alloy, the Al—Mn intermediate alloy, the Al—Sr intermediate alloy, the Al—Sc intermediate alloy, and the Al—Er intermediate alloy into the crucible, and continuing to heat until the intermediate alloys are completely melted; then adding the pure Zn ingot into the crucible, and after the pure Zn ingot is completely melted, controlling the temperature of the molten aluminum alloy to 730-750° C. (e.g., 730° C., 735° C., 740° C., 745° C., 750° C., etc.), stirring for 5-8 min (e.g., 5 min, 6 min, 7 min, 8 min, etc.), removing scum on the surface of the molten aluminum alloy; then adding the pure Mg ingot, and introducing a protective gas; after the pure Mg ingot is completely melted, stirring the molten aluminum alloy evenly, measuring and adjusting the content of each element until the required ranges are reached, and carrying out refining treatment for 3-5 min. When the temperature of the molten alloy is cooled to about 700° C., the molten alloy is poured into an alloy mold to form an alloy ingot, and then casted by conventional die casting to obtain a required aluminum alloy structural member product.

According to another aspect of the present disclosure, the present disclosure provides an aluminum alloy structural member. According to an embodiment of the present disclosure, at least a part of the aluminum alloy structural member is made of the aluminum alloy described above. The aluminum alloy structural member has both good strength and ideal thermal conductivity, can be formed by a simple die-casting process, has a good use effect even when having a thinner thickness, and features low preparation costs.

According to an embodiment of the present disclosure, the aluminum alloy structural member may be one or more of a structural member of a 3C product, a structural member of an automobile radiator, a structural member of a turbine disc, or a structural member of a lighting device. Specifically, the aluminum alloy structural member may be a mobile phone middle frame, a mobile phone back cover, a mobile phone middle board or other structural members. In this way, the structural member has good mechanical strength, plasticity and thermal conductivity, which can well meet the user's requirements for high strength and high thermal conductivity of the product, and improve user experience.

Examples of the present disclosure will be described in detail below.

Example 1

After the ingredients were calculated, standard intermediate alloys and elemental metals were weighed. Then an ingot was obtained according to the smelting-based aluminum alloy preparation method provided below. The ingot was die-casted to obtain a die-casting aluminum alloy Al of the present disclosure, with the contents in percentage by weight of its main elements being as shown in Table 1.

Smelting-based aluminum alloy preparation method:

The pure aluminum ingot and the Al—Si intermediate alloy were smelted in a crucible until the mixture was completely melted. The Al—Cu intermediate alloy, the Al—Fe intermediate alloy, the Al—Mn intermediate alloy, the Al—Sr intermediate alloy, the Al—Sc intermediate alloy, and the Al—Er intermediate alloy were added into the crucible, and continued to be heated until the intermediate alloys were completely melted. The pure Zn ingot was added into the crucible, and after the pure Zn ingot was completely melted, the temperature of the molten aluminum alloy was controlled to 730-750° C. The molten aluminum alloy was stirred for 5-8 minutes. Scum on the surface of the molten aluminum alloy was removed. Then the pure Mg ingot was added, and a protective gas was introduced. After the pure Mg ingot was completely melted, the molten aluminum alloy was stirred evenly. The content of each element is measured and adjusted until the required ranges were reached, and refining treatment was carried out for 3-5 min. When the temperature of the molten alloy is cooled to about 700° C., the molten alloy is poured into an alloy mold to form an alloy ingot, and then casted by conventional die casting to obtain a required casting product.

Example 2

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A2 of the present disclosure, with the contents in percentage by Weight of its Main Elements being as Shown in Table 1.

Example 3

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A3 of the present disclosure, with the contents in percentage by weight of its main elements being as shown in Table 1.

Example 4

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A4 of the present disclosure, with the contents in percentage by weight of its main elements being as shown in Table 1.

Example 5

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A5 of the present disclosure, with the contents in percentage by weight of its main elements being as shown in Table 1.

Example 6

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A6 of the present disclosure, with the contents in percentage by weight of its main elements being as shown in Table 1.

Example 7

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A7 of the present disclosure, with the contents in percentage by weight of its main elements being as shown in Table 1.

Example 8

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A8 of the present disclosure, with the contents in percentage by weight of its main elements being as shown in Table 1.

Example 9

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A9 of the present disclosure, with the contents in percentage by weight of its main elements being as shown in Table 1.

Examples 10-33

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy A10-A33 of the present disclosure, with the contents in percentage by weight of its main elements being as shown in Table 1.

Comparative Example 1

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B1 of the present disclosure, with the contents in percentage by weight of its main elements being as shown in Table 1.

Comparative Example 2

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B2 of the present disclosure, with the contents in percentage by weight of its main elements being as shown in Table 1.

Comparative Example 3

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B3 of the present disclosure, with the contents in percentage by weight of its main elements being as shown in Table 1.

Comparative Example 4

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B4 of the present disclosure, with the contents in percentage by weight of its main elements being as shown in Table 1.

Comparative Example 5

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B5 of the present disclosure, with the contents in percentage by weight of its main elements being as shown in Table 1.

Comparative Example 6

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B6 of the present disclosure, with the contents in percentage by weight of its main elements being as shown in Table 1.

Comparative Example 7

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B7 of the present disclosure, with the contents in percentage by weight of its main elements being as shown in Table 1.

Comparative Example 8

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B8 of the present disclosure, with the contents in percentage by weight of its main elements being as shown in Table 1.

Comparative Example 9

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B9 of the present disclosure, with the contents in percentage by weight of its main elements being as shown in Table 1.

Comparative Example 10

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B10 of the present disclosure, with the contents in percentage by weight of its main elements being as shown in Table 1.

Comparative Example 11

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B11 of the present disclosure, with the contents in percentage by weight of its main elements being as shown in Table 1.

Comparative Example 12

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B12 of the present disclosure, with the contents in percentage by weight of its main elements being as shown in Table 1.

Comparative Example 13

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B13 of the present disclosure, with the contents in percentage by weight of its main elements being as shown in Table 1.

Comparative Example 14

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B14 of the present disclosure, with the contents in percentage by weight of its main elements being as shown in Table 1.

Comparative Example 15

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B15 of the present disclosure, with the contents in percentage by weight of its main elements being as shown in Table 1.

Comparative Example 16

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B16 of the present disclosure, with the contents in percentage by weight of its main elements being as shown in Table 1.

Comparative Example 17

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B17 of the present disclosure, with the contents in percentage by weight of its main elements being as shown in Table 1.

Comparative Example 18

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B18 of the present disclosure, with the contents in percentage by weight of its main elements being as shown in Table 1.

Comparative Example 19

After the ingredients were calculated, standard intermediate alloys and elemental metals were weighed. Then an ingot was obtained according to the smelting-based aluminum alloy preparation method provided in Example 1. The ingot was die-casted to obtain a die-casting aluminum alloy B19 of the present disclosure, with the contents in percentage by weight of its main elements being as shown in Table 1.

TABLE 1

(Unit: wt %)

| | Si | Zn | Mg | Cu | Fe | Mn | Sr | Sc | Er | Inevitable impurities and the balance of Al |
|---|---|---|---|---|---|---|---|---|---|---|
| Example 1 | 10.5 | 9.5 | 0.6 | 0.8 | 0.5 | 0.1 | 0 | 0 | 0 | 78.000 |
| Example 2 | 10.5 | 9.5 | 0.6 | 0.8 | 0.5 | 0.15 | 0 | 0 | 0 | 77.950 |
| Example 3 | 10.5 | 9.5 | 0.6 | 0.8 | 0.5 | 0.2 | 0 | 0 | 0 | 77.900 |
| Example 4 | 9 | 10 | 0.9 | 0.5 | 0.6 | 0.08 | 0.05 | 0.04 | 0 | 78.830 |
| Example 5 | 9.8 | 10.5 | 1.4 | 0.2 | 0.2 | 0.1 | 0 | 0.01 | 0 | 77.790 |
| Example 6 | 12 | 8 | 0.5 | 0.8 | 0.6 | 0.2 | 0.08 | 0 | 0.4 | 77.420 |
| Example 7 | 9 | 11 | 0.7 | 0.4 | 0.4 | 0.13 | 0.04 | 0.01 | 0.1 | 78.220 |
| Example 8 | 9 | 11 | 0.7 | 0.4 | 0.4 | 0.13 | 0.03 | 0.01 | 0.1 | 78.230 |

TABLE 1-continued (Unit: wt %)

| | Si | Zn | Mg | Cu | Fe | Mn | Sr | Sc | Er | Inevitable impurities and the balance of Al |
|---|---|---|---|---|---|---|---|---|---|---|
| Example 9 | 9 | 11 | 0.7 | 0.4 | 0.4 | 0.13 | 0.09 | 0.01 | 0.1 | 78.170 |
| Example 10 | 9 | 11 | 0.7 | 0.4 | 0.4 | 0.13 | 0.01 | 0.01 | 0.1 | 78.250 |
| Example 11 | 9 | 11 | 0.7 | 0.4 | 0.4 | 0.13 | 0.04 | 0.02 | 0.1 | 78.210 |
| Example 12 | 9 | 11 | 0.7 | 0.4 | 0.4 | 0.13 | 0.04 | 0.04 | 0.1 | 78.190 |
| Example 13 | 9 | 11 | 0.7 | 0.4 | 0.4 | 0.13 | 0.04 | 0.01 | 0.2 | 78.120 |
| Example 14 | 9 | 11 | 0.7 | 0.4 | 0.4 | 0.13 | 0.04 | 0.01 | 0.45 | 77.870 |
| Example 15 | 10.5 | 10 | 0.8 | 0.55 | 0.5 | 0.15 | 0.03 | 0 | 0.15 | 77.320 |
| Example 16 | 10 | 10.5 | 0.7 | 0.35 | 0.6 | 0.18 | 0.05 | 0.015 | 0.2 | 77.405 |
| Example 17 | 10.5 | 10.5 | 0.7 | 0.35 | 0.6 | 0.18 | 0.05 | 0.015 | 0.2 | 76.905 |
| Example 18 | 9 | 10.5 | 0.7 | 0.35 | 0.6 | 0.18 | 0.05 | 0.015 | 0.2 | 78.405 |
| Example 19 | 12 | 10.5 | 0.7 | 0.35 | 0.6 | 0.18 | 0.05 | 0.015 | 0.2 | 75.405 |
| Example 20 | 10 | 10 | 0.7 | 0.35 | 0.6 | 0.18 | 0.05 | 0.015 | 0.2 | 77.905 |
| Example 21 | 10 | 8 | 0.7 | 0.35 | 0.6 | 0.18 | 0.05 | 0.015 | 0.2 | 79.905 |
| Example 22 | 10 | 11 | 0.7 | 0.35 | 0.6 | 0.18 | 0.05 | 0.015 | 0.2 | 76.905 |
| Example 23 | 11 | 9.5 | 1 | 0.65 | 0.35 | 0.12 | 0.02 | 0.025 | 0.35 | 76.985 |
| Example 24 | 11 | 9.5 | 0.8 | 0.65 | 0.35 | 0.12 | 0.02 | 0.025 | 0.35 | 77.185 |
| Example 25 | 11 | 9.5 | 1.2 | 0.65 | 0.35 | 0.12 | 0.02 | 0.025 | 0.35 | 76.785 |
| Example 26 | 11 | 9.5 | 0.5 | 0.65 | 0.35 | 0.12 | 0.02 | 0.025 | 0.35 | 77.485 |
| Example 27 | 11 | 9.5 | 1 | 0.4 | 0.35 | 0.12 | 0.02 | 0.025 | 0.35 | 77.235 |
| Example 28 | 11 | 9.5 | 1 | 0.3 | 0.35 | 0.12 | 0.02 | 0.025 | 0.35 | 77.335 |
| Example 29 | 11 | 9.5 | 1 | 0.7 | 0.35 | 0.12 | 0.02 | 0.025 | 0.35 | 76.935 |
| Example 30 | 11 | 9.5 | 1 | 0.65 | 0.35 | 0.14 | 0.02 | 0.025 | 0.35 | 76.965 |
| Example 31 | 11 | 9.5 | 1 | 0.65 | 0.6 | 0.12 | 0.02 | 0.025 | 0.35 | 76.735 |
| Example 32 | 11 | 9.5 | 1 | 0.65 | 0.1 | 0.12 | 0.02 | 0.025 | 0.35 | 77.235 |
| Example 33 | 10.5 | 10 | 0.8 | 0.55 | 0 | 0.15 | 0.03 | 0 | 0.15 | 77.820 |
| Comparative Example 1 | 12 | 1 | 0.02 | 2 | 0.9 | 0.5 | 0 | 0 | 0 | 83.580 |
| Comparative Example 2 | 10 | 3 | 0.6 | 0.6 | 0.35 | 0.2 | 0.03 | 0.01 | 0 | 85.210 |
| Comparative Example 3 | 9.5 | 10.5 | 2 | 0.3 | 0.55 | 0.08 | 0.05 | 0 | 0 | 77.020 |
| Comparative Example 4 | 2 | 8 | 1 | 0.23 | 0.6 | 0.15 | 0 | 0 | 0.2 | 87.820 |
| Comparative Example 5 | 9.5 | 10.5 | 0.5 | 0.3 | 0.55 | 1 | 0.05 | 0 | 0 | 77.600 |
| Comparative Example 6 | 15 | 10.5 | 0.7 | 0.35 | 0.6 | 0.18 | 0.05 | 0.015 | 0.2 | 72.405 |
| Comparative Example 7 | 8 | 10.5 | 0.7 | 0.35 | 0.6 | 0.18 | 0.05 | 0.015 | 0.2 | 79.405 |
| Comparative Example 8 | 10 | 13 | 0.7 | 0.35 | 0.6 | 0.18 | 0.05 | 0.015 | 0.2 | 74.905 |
| Comparative Example 9 | 10 | 6 | 0.7 | 0.35 | 0.6 | 0.18 | 0.05 | 0.015 | 0.2 | 81.905 |
| Comparative Example 10 | 10 | 10.5 | 0.1 | 0.35 | 0.6 | 0.18 | 0.05 | 0.015 | 0.2 | 78.005 |
| Comparative Example 11 | 10 | 10.5 | 1.8 | 0.35 | 0.6 | 0.18 | 0.05 | 0.015 | 0.2 | 76.305 |
| Comparative Example 12 | 10 | 10.5 | 0.7 | 0.1 | 0.6 | 0.18 | 0.05 | 0.015 | 0.2 | 77.655 |
| Comparative Example 13 | 10 | 10.5 | 0.7 | 1 | 0.6 | 0.18 | 0.05 | 0.015 | 0.2 | 76.755 |
| Comparative Example 14 | 10 | 10.5 | 0.7 | 0.35 | 0.8 | 0.18 | 0.05 | 0.015 | 0.2 | 77.205 |
| Comparative Example 15 | 10 | 10.5 | 0.7 | 0.35 | 0.6 | 0.05 | 0.05 | 0.015 | 0.2 | 77.535 |
| Comparative Example 16 | 10 | 10.5 | 0.7 | 0.35 | 0.6 | 0.3 | 0.05 | 0.015 | 0.2 | 77.285 |
| Comparative Example 17 | 10 | 10.5 | 0.7 | 0.35 | 0.6 | 0.18 | 0.15 | 0.015 | 0.2 | 77.305 |
| Comparative Example 18 | 10 | 10.5 | 0.7 | 0.35 | 0.6 | 0.18 | 0.05 | 0.08 | 0.2 | 77.340 |
| Comparative Example 19 | 10 | 10.5 | 0.7 | 0.35 | 0.6 | 0.18 | 0.05 | 0.015 | 0.8 | 76.805 |

Mechanical Property Test

This test was used to determine the mechanical properties of the aluminum alloys obtained in Examples 1-33 and Comparative Examples 1-19 at room temperature. The tensile strength, yield strength and elongation rate were tested with reference to "GB/T 228.1-2010 Metallic materials—Tensile testing—Part 1: Method of test at room temperature". The specific results are as shown in Table 2.

Thermal Conductivity Test

This test was used to determine the thermal conductivity of the aluminum alloys obtained in Examples 1-33 and Comparative Examples 1-19 at room temperature. The thermal conductivity was tested with reference to "ASTM E1461 Standard Test Method for Thermal Diffusivity by the Flash Method". The specific results are as shown in Table 2.

Impurity Content Test

The content of each component in the aluminum alloys obtained in Examples 1-33 was tested by laser direct reading spectroscopy. In all the aluminum alloys, the total content of impurities was below 0.1%, and the content of each impurity element was below 0.01%.

TABLE 2

| | Yield strength (MPa) | Tensile strength (MPa) | Elongation rate (%) | Thermal conductivity (W/m · K) |
|---|---|---|---|---|
| Example 1 | 254 | 390 | 3.07 | 127 |
| Example 2 | 255 | 396 | 3.39 | 126 |
| Example 3 | 256 | 394 | 3.27 | 125 |
| Example 4 | 247 | 393 | 3.63 | 134 |
| Example 5 | 257 | 406 | 3.39 | 125 |
| Example 6 | 253 | 391 | 3.18 | 136 |
| Example 7 | 253 | 410 | 3.87 | 135 |
| Example 8 | 253 | 401 | 3.43 | 135 |
| Example 9 | 252 | 392 | 3.1 | 137 |
| Example 10 | 251 | 392 | 3.15 | 132 |
| Example 11 | 252 | 406 | 3.83 | 132 |
| Example 12 | 252 | 394 | 3.36 | 131 |
| Example 13 | 253 | 409 | 3.76 | 132 |
| Example 14 | 256 | 393 | 3.23 | 130 |
| Example 15 | 260 | 413 | 3.63 | 129 |
| Example 16 | 259 | 415 | 3.73 | 133 |
| Example 17 | 267 | 420 | 3.55 | 132 |
| Example 18 | 249 | 398 | 3.64 | 135 |
| Example 19 | 270 | 420 | 3.32 | 129 |
| Example 20 | 261 | 412 | 3.43 | 136 |
| Example 21 | 245 | 390 | 3.56 | 135 |
| Example 22 | 266 | 408 | 3.15 | 128 |
| Example 23 | 265 | 413 | 3.32 | 135 |
| Example 24 | 264 | 415 | 3.45 | 136 |
| Example 25 | 269 | 415 | 3.25 | 134 |
| Example 26 | 260 | 409 | 3.34 | 135 |
| Example 27 | 263 | 419 | 3.76 | 137 |
| Example 28 | 260 | 411 | 3.42 | 136 |
| Example 29 | 266 | 418 | 3.31 | 133 |
| Example 30 | 268 | 420 | 3.43 | 136 |
| Example 31 | 269 | 417 | 3.18 | 134 |
| Example 32 | 259 | 394 | 3.25 | 138 |
| Example 33 | 257 | 395 | 3.33 | 138 |
| Comparative Example 1 | 170 | 237 | 2.5 | 96 |
| Comparative Example 2 | 198 | 309 | 2.68 | 119 |
| Comparative Example 3 | 269 | 313 | 1.1 | 93 |
| Comparative Example 4 | 145 | 190 | 2.31 | 139 |
| Comparative Example 5 | 260 | 394 | 2.75 | 103 |
| Comparative Example 6 | 308 | 420 | 2.53 | 110 |
| Comparative Example 7 | 237 | 375 | 3.11 | 122 |
| Comparative Example 8 | 265 | 408 | 3.19 | 120 |
| Comparative Example 9 | 208 | 355 | 3.66 | 130 |
| Comparative Example 10 | 243 | 395 | 3.76 | 125 |
| Comparative Example 11 | 284 | 335 | 1.34 | 99 |
| Comparative Example 12 | 250 | 393 | 3.28 | 123 |
| Comparative Example 13 | 254 | 315 | 1.98 | 118 |
| Comparative Example 14 | 257 | 345 | 2.32 | 116 |

TABLE 2-continued

| | Yield strength (MPa) | Tensile strength (MPa) | Elongation rate (%) | Thermal conductivity (W/m · K) |
|---|---|---|---|---|
| Comparative Example 15 | 243 | 382 | 3 | 132 |
| Comparative Example 16 | 247 | 384 | 2.93 | 129 |
| Comparative Example 17 | 257 | 363 | 2.78 | 130 |
| Comparative Example 18 | 258 | 376 | 2.89 | 135 |
| Comparative Example 19 | 263 | 365 | 2.42 | 124 |

It can be seen from the data in the above table that the aluminum alloys of the present disclosure have relatively high mechanical properties (yield strength and tensile strength), elongation rate and thermal conductivity. Among them, the aluminum alloys in Examples 16-17, 20, 23-24, 27 and 30 have better properties. As can be seen from Comparative Examples 4 and 6, if the silicon content is too low, the mechanical properties and elongation rate will be poor, and if the silicon content is too high, the mechanical properties will be improved, but the thermal conductivity will decrease significantly. As can be seen from Comparative Examples 1-19, if the content of each component is not within the protection scope of this application, the mechanical properties (yield strength and tensile strength), elongation rate and thermal conductivity of the aluminum alloy cannot be improved at the same time, and none or only one or two of the above properties are improved, i.e., the mechanical properties (yield strength and tensile strength), elongation rate and thermal conductivity cannot be well balanced. In summary, by adjusting the components of the aluminum alloy of the present disclosure and the ratio thereof, a coordination and synergy is achieved between the components, so that the aluminum alloy has good mechanical properties, elongation rate and thermal conductivity at the same time, can well meet the use requirements for high strength, high thermal conductivity and toughness (elongation rate), and is suitable for the manufacture of structural members of 3C products, automobile radiators, turbine discs, lighting device, etc.

In the description of this specification, the description of the reference terms "an embodiment", "some embodiments", "an example", "a specific example", "some examples," and the like means that specific features, structures, materials or characteristics described in combination with the embodiment(s) or example(s) are included in at least one embodiment or example of the present disclosure. In this specification, schematic descriptions of the foregoing terms are not necessarily directed at the same embodiment or example. Besides, the specific features, the structures, the materials or the characteristics that are described may be combined in proper manners in any one or more embodiments or examples. In addition, a person skilled in the art may integrate or combine different embodiments or examples described in the specification and features of the different embodiments or examples as long as they are not contradictory to each other.

Although the embodiments of the present disclosure have been shown and described above, it can be understood that, the foregoing embodiments are exemplary and should not be understood as limitation to the present disclosure. A person of ordinary skill in the art can make changes, modifications, replacements, or variations to the foregoing embodiments within the scope of the present disclosure.

What is claimed is:

1. An aluminum alloy, based on a total weight of the aluminum alloy, in percentages by weight, comprising:

9-12% of Si;
8-11% of Zn;
0.5-1.5% of Mg;
0.2-0.8% of Cu;
0-0.6% of Fe;
0.08-0.25% of Mn;
0.02-0.05% of Sr;
0.015-0.025% of Sc;
0-0.5% of Er; and
73.2-82.22% of Al.

2. The aluminum alloy of claim 1, wherein based on the total weight of the aluminum alloy, the aluminum alloy comprises, in percentages by weight:

10-11% of Si;
9.5-10.5% of Zn;
0.7-1% of Mg;
0.35-0.65% of Cu;
0.35-0.5% of Fe;
0.12-0.18% of Mn;
0.15-0.35% of Er; and
75.745-78.795% of Al.

3. The aluminum alloy of claim 2, wherein a mass ratio of Fe to Mn is (2.5-3.5):1.

4. The aluminum alloy of claim 1, wherein a content of each one of impurity elements in the aluminum alloy based on the total weight of the aluminum alloy is less than 0.01%, in percentages by weight.

5. The aluminum alloy of claim 4, wherein a mass ratio of Fe to Mn is (2.5-3.5):1.

6. The aluminum alloy of claim 1, wherein a total content of the impurity elements in the aluminum alloy based on the total weight of the aluminum alloy is less than 0.1%, in percentages by weight.

7. The aluminum alloy of claim 6, wherein a mass ratio of Fe to Mn is (2.5-3.5):1.

8. The aluminum alloy of claim 1, wherein a mass ratio of Fe to Mn is (2.5-3.5):1.

9. The aluminum alloy of claim 1, wherein a yield strength of the aluminum alloy is greater than or equal to 245 MPa.

10. The aluminum alloy of claim 9, wherein the yield strength of the aluminum alloy is 245 to 270 MPa.

11. The aluminum alloy of claim 1, wherein a tensile strength of the aluminum alloy is greater than or equal to 390 MPa.

12. The aluminum alloy of claim 11, wherein the tensile strength of the aluminum alloy is 390 to 420 MPa.

13. The aluminum alloy of claim 1, wherein an elongation rate of the aluminum alloy is greater than or equal to 3%.

14. The aluminum alloy of claim 13, wherein the elongation rate of the aluminum alloy is 3% to 4%.

15. The aluminum alloy of claim 1, wherein a thermal conductivity of the aluminum alloy is greater than or equal to 125 W/m·K.

16. The aluminum alloy of claim 15, wherein the thermal conductivity of the aluminum alloy is 125-140 W/m·K.

17. A method for preparing the aluminum alloy of claim 1, comprising:

heating to melt aluminum, a silicon-containing raw material, a copper-containing raw material, an iron-containing raw material, a manganese-containing raw material, a strontium-containing raw material, a scandium-containing raw material, an erbium-containing raw material, a zinc-containing raw material, and a magnesium-containing raw material to obtain a molten aluminum alloy; and sequentially stirring, refining and casting the molten aluminum alloy to obtain the aluminum alloy.

18. The method of claim 17, comprising:

heating to melt the aluminum and the silicon-containing raw material, heating to melt after adding the copper-containing raw material, the iron-containing raw material, the manganese-containing raw material, the strontium-containing raw material, the scandium-containing raw material, and the erbium-containing raw material to obtain a first molten aluminum alloy;

adding the zinc-containing raw material to the first molten aluminum alloy, and heating to melt, scum removing to obtain a second molten aluminum alloy;

adding the magnesium-containing raw material to the second molten aluminum alloy under a protective atmosphere, and heating to melt to obtain a third molten aluminum alloy; and sequentially stirring, refining and casting the third molten aluminum alloy to obtain the aluminum alloy.

19. An aluminum alloy structural member, wherein at least a part of the aluminum alloy structural member is made of an aluminum alloy, the aluminum alloy, based on a total weight of the aluminum alloy, in percentages by weight, comprising:

9-12% of Si;
8-11% of Zn;
0.5-1.5% of Mg;
0.2-0.8% of Cu;
0-0.6% of Fe;
0.08-0.25% of Mn;
0.02-0.05% of Sr;
0.015-0.025% of Sc;
0-0.5% of Er; and
73.2-82.22% of Al.

20. The aluminum alloy structural member of claim 19, wherein the aluminum alloy structural member is one or more of a structural member of a computer, communication and consumer electronics (3C) product, a structural member of an automobile radiator, a structural member of a turbine disc or a structural member of a lighting device.

* * * * *